US012497233B2

(12) United States Patent
Shin et al.

(10) Patent No.: US 12,497,233 B2
(45) Date of Patent: Dec. 16, 2025

(54) METAL FOIL CORE

(71) Applicant: SK NEXILIS CO., LTD., Jeongeup-si (KR)

(72) Inventors: In Cheol Shin, Jeongeup-si (KR); In Soo Jung, Jeongeup-si (KR); Jae Hoon Jung, Jeongeup-si (KR)

(73) Assignee: SK NEXILIS CO., LTD., Jeongeup-si (KR)

( * ) Notice: Subject to any disclaimer, the term of this patent is extended or adjusted under 35 U.S.C. 154(b) by 240 days.

(21) Appl. No.: 18/216,296

(22) Filed: Jun. 29, 2023

(65) Prior Publication Data

US 2024/0158157 A1 May 16, 2024

(30) Foreign Application Priority Data

Nov. 10, 2022 (KR) ..... 10-2022-0149161

(51) Int. Cl.
*B65H 75/26* (2006.01)
*B65D 85/672* (2006.01)
*B65H 18/28* (2006.01)

(52) U.S. Cl.
CPC ..... *B65D 85/672* (2013.01); *B65H 18/28* (2013.01); *B65H 2701/173* (2013.01); *B65H 2701/18442* (2013.01)

(58) Field of Classification Search
CPC ..... B65H 75/26; B65H 75/50; B65H 75/265; B65D 85/672; Y02E 60/10
See application file for complete search history.

(56) References Cited

U.S. PATENT DOCUMENTS 3,752,414 A * 8/1973 Urquhart ..... B65H 75/26 242/118.32
4,462,556 A * 7/1984 Graham, Jr. ..... B65H 75/50 138/129
9,064,805 B1 * 6/2015 Frey ..... H01M 4/382
2007/0012815 A1 * 1/2007 Holden ..... B31C 3/00 493/299

(Continued)

FOREIGN PATENT DOCUMENTS

CN 205615902 U 10/2016
DE 202009016378 U1 3/2010

(Continued)

OTHER PUBLICATIONS

Office Action for related Taiwanese Application No. 11320338060; action dated Apr. 8, 2024; (5 pages).

(Continued)

*Primary Examiner* — Sang K Kim
(74) *Attorney, Agent, or Firm* — Crowell & Moring LLP

(57) ABSTRACT

The present disclosure relates to a metal foil core including a winding member around which a metal foil is wound, a first protrusion member protruding from the winding member in a first direction (direction of arrow FD) of a first axis direction (X-axis direction), a second protrusion member protruding from the winding member in a second direction (direction of arrow SD) opposite to the first direction (direction of arrow FD) of the first axis direction (X-axis direction), and a first inducing groove formed in the first protrusion member to be disposed between both ends of the first protrusion member in the first axis direction (X-axis direction).

20 Claims, 14 Drawing Sheets

(56) References Cited

U.S. PATENT DOCUMENTS

| | | | | |
|---|---|---|---|---|
| 2014/0361109 | A1 | 12/2014 | Liu et al. | |
| 2020/0095082 | A1* | 3/2020 | Schomber, Jr. | B41F 21/00 |
| 2021/0354950 | A1 | 11/2021 | Watkins et al. | |
| 2021/0354952 | A1* | 11/2021 | Watkins | B65H 75/26 |

FOREIGN PATENT DOCUMENTS

| | | | |
|---|---|---|---|
| EP | 0650777 | A1 | 5/1995 |
| JP | H05200932 | A | 8/1993 |
| JP | H0710326 | A | 1/1995 |
| JP | 2001106438 | A | 4/2001 |
| JP | 2001310873 | A | 11/2001 |
| JP | 2005187199 | A | 7/2005 |
| JP | 2013227073 | A | 11/2013 |
| JP | 2015093752 | A | 5/2015 |
| JP | 2021068618 | A | 4/2021 |
| JP | 2022035680 | A | 3/2022 |
| KR | 101816830 | B1 | 2/2018 |
| KR | 20220004423 | A | 1/2022 |
| KR | 20220041024 | A | 3/2022 |

OTHER PUBLICATIONS

Office Action for related Korean Application No. 10-2022-0149161; action dated Jul. 5, 2024; (6 pages).
Office Action for related Canadian Application No. 3,197,907; action dated Aug. 27, 2024; (6 pages).
Extended European Search Report for related European Application No. 23169726.9; action dated Sep. 29, 2023; (7 pages).
Office Action for related Japanese Application No. 2023-072283; action dated Apr. 30, 2024; (4 pages).

* cited by examiner

FIG. 4

| Classification | With or without groove | PLLR | PDTR | Ratio of width to processing depth | Core state | Fusilli | MD buckle |
|---|---|---|---|---|---|---|---|
| Example 1 | Presence | 0.1 | 0.1 | 0.5 | Good | Good | Good |
| Example 2 | Presence | 0.1 | 0.2 | 0.5 | Good | Good | Good |
| Example 3 | Presence | 0.3 | 0.4 | 0.5 | Good | Good | Good |
| Example 4 | Presence | 0.3 | 0.5 | 0.5 | Good | Good | Good |
| Comparative example 1 | Absence | | | | Good | Bad | Bad |
| Comparative example 2 | Presence | 0.05 | 0.3 | 0.5 | Good | Bad | Bad |
| Comparative example 3 | Presence | 0.4 | 0.3 | 0.5 | Good | Product separation | Product separation |
| Comparative example 4 | Presence | 0.2 | 0.05 | 0.5 | Good | Bad | Bad |
| Comparative example 5 | Presence | 0.2 | 0.7 | 0.5 | Damaged | - | - |
| Comparative example 6 | Presence | 0.2 | 0.3 | 0.3 | Good | Bad | Bad |
| Comparative example 7 | Presence | 0.2 | 0.3 | 0.7 | Deformed | Bad | Bad |

METAL FOIL CORE

CROSS-REFERENCE TO RELATED APPLICATIONS

This application claims the benefit of the Korean Patent Applications No. 10-2022-0149161 filed on Nov. 10, 2022, which are hereby incorporated by reference as if fully set forth herein.

FIELD

The present disclosure relates to a metal foil core for supporting a metal foil used in manufacturing a negative electrode for a secondary battery, a flexible printed circuit board, and the like.

BACKGROUND

Metal foils are used to manufacture various products such as negative electrodes for a secondary battery, flexible printed circuit boards (FPCBs), and the like. For example, cooper foil that is one type of metal foil may be manufactured through an electroplating method in which an electrolyte is supplied between a positive electrode and a negative electrode and then a current flows therethrough.

The metal foils are transported to customers in a state wound around cores. For example, the metal foils wound around the cores may be transported on transportation units such as vehicles, ships, railroad vehicles, and airplanes. The core is transported in a state in which protrusion portions protruding from both sides of the wound metal foil are supported on an accommodation device.

Here, since a load of the metal foil is continuously applied to a wound portion of the core around which the metal foil is wound during a transportation process, the wound portion of the core may be sagged. Further, as vibrations, shaking, impacts, and the like generated during the transportation are transmitted to the core, the wound portion of the core may be deformed.

In this way, the sag, the deformation, and the like generated in the core cause defects such as machine direction (MD) buckle and fusilli in the metal foil wound around the core.

SUMMARY

The present disclosure is directed to providing a metal foil core capable of reducing sag, deformation, and the like generated in the core due to a load of a metal foil and vibrations, shaking, impact, and the like transmitted from the outside.

In order to solve the above problems, the present disclosure may include the following configurations.

A metal foil core according to the present disclosure includes a winding member around which a metal foil is wound, a first protrusion member protruding from the winding member in a first direction of a first axis direction, a second protrusion member protruding from the winding member in a second direction opposite to the first direction of the first axis direction, and a first inducing groove formed in the first protrusion member to be disposed between both ends of the first protrusion member in the first axis direction.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings:

FIG. 4 is a table illustrating experimental results of examples and comparative examples of the metal foil core according to the present disclosure;

DETAILED DESCRIPTION

Hereinafter, embodiments of a metal foil core according to the present disclosure will be described in detail with reference to the accompanying drawings. Meanwhile, two alternated long and short dashed lines illustrated parallel to each other in FIGS. 1 and 2 are omitted lines.

Figure 1:
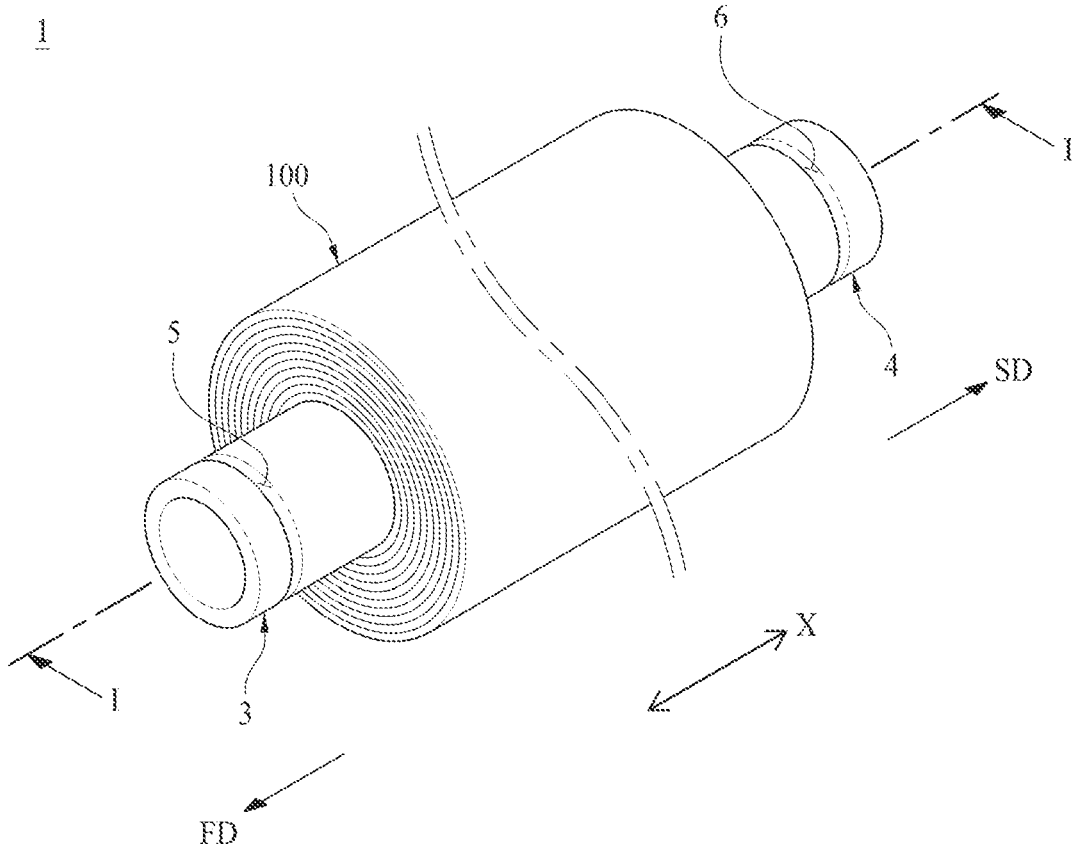
FIG. 1 is a schematic perspective view illustrating a metal foil core according to the present disclosure.

Referring to FIG. 1, a metal foil core 1 according to the present disclosure is adapted to support metal foil 100 used to manufacture various products such as a negative electrode for a secondary battery and a flexible printed circuit board (FPCB). For example, the metal foil core 1 according to the present disclosure may be used to support copper foil belonging to the metal foil 100. The metal foil 100 may be wound around the metal foil core 1 according to the present disclosure and may be transported on transportation units while wound around the metal foil core 1 according to the present disclosure. In this case, the metal foil core 1 according to the present disclosure around which the metal foil 100 is wound may be transported while accommodated in an accommodation device (not illustrated).

The metal foil core 1 according to the present disclosure may include a winding member 2, a first protrusion member 3, and a second protrusion member 4.

Figure 2:
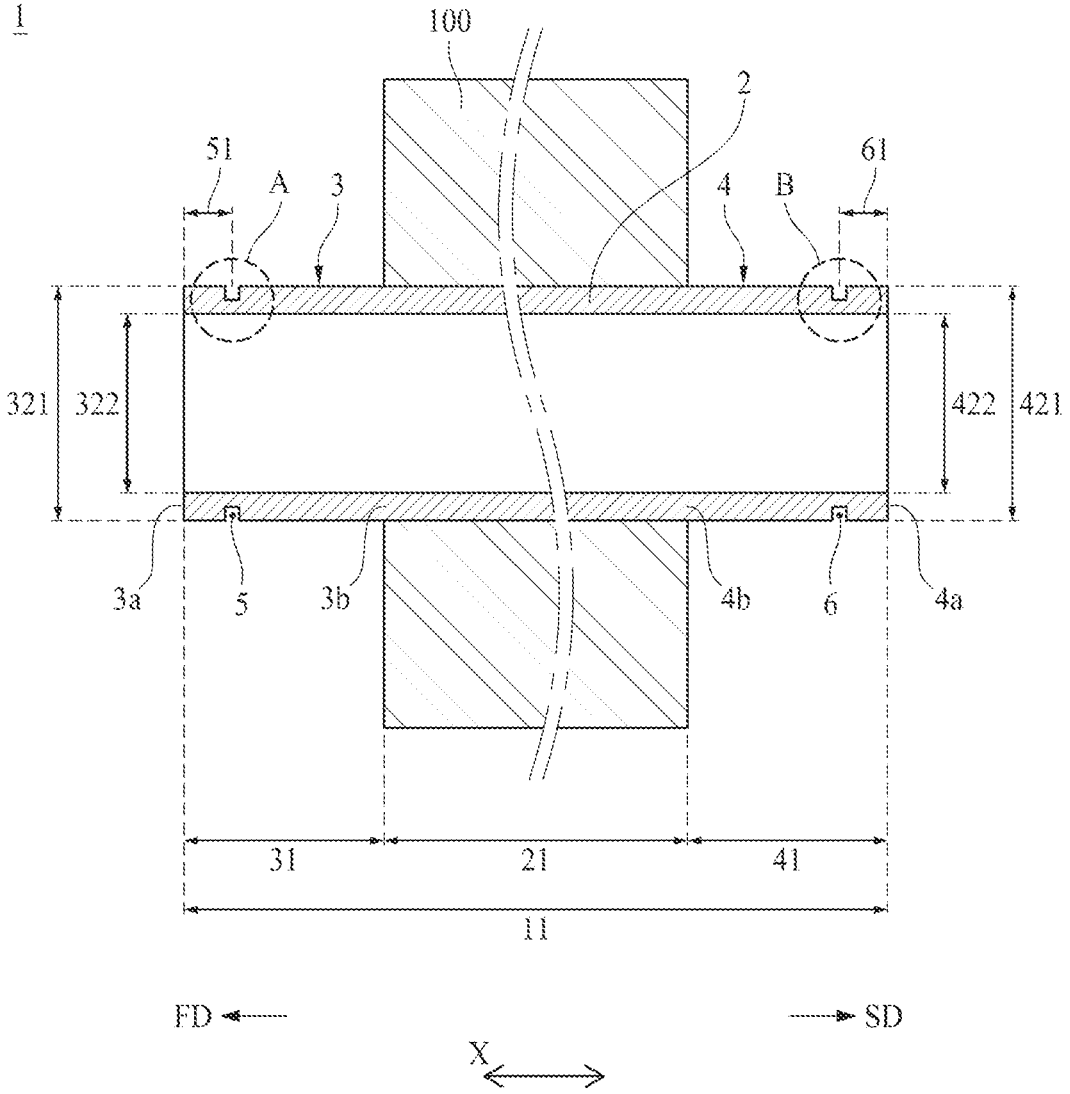
FIG. 2 is a schematic side cross-sectional view illustrating the metal foil core along line I-I of FIG. 1 according to the present disclosure.

Referring to FIGS. 1 to 2, the winding member 2 is adapted to support the metal foil 100. The metal foil 100 may be wound around the winding member 2. The winding member 2 may be formed to have a long length in a first axis direction (X-axis direction). For example, the winding member 2 may be formed in a hollow cylindrical shape extending in the first axis direction (X-axis direction).

The metal foil 100 containing at least one of iron (Fe), aluminum (Al), copper (Cu), silver (Ag), gold (Au), nickel (Ni), titanium (Ti), zinc (Zn), platinum (Pt), manganese (Mg), tin (Sn), silicon (Si), and stainless steel (SUS) may be wound around the winding member 2. The metal foil 100 may have a thickness of 5 mm or less.

The winding member 2 may be disposed between the first protrusion member 3 and the second protrusion member 4 in the first axis direction (X-axis direction). Accordingly, when the metal foil 100 is wound around the winding member 2, the first protrusion member 3 may protrude in a first direction (FD arrow direction) of the first axis direction (X-axis direction). When the metal foil 100 is wound around the winding member 2, the second protrusion member 4 may protrude in a second direction (SD arrow direction) of the first axis direction (X-axis direction). The second direction (SD arrow direction) and the first direction (FD arrow direction) may be opposite to each other.

The winding member 2, the first protrusion member 3, and the second protrusion member 4 may be formed integrally. For example, the metal foil core 1 according to the present disclosure may be formed in a hollow cylindrical shape extending in the first axis direction (X-axis direction). In this case, the winding member 2, the first protrusion member 3, and the second protrusion member 4 may be formed to have the same external diameter and the same internal diameter. The winding member 2, the first protrusion member 3, and the second protrusion member 4 may be formed using at least one of a metal, a glass fiber, a resin, a plastic, a wood, and a polymer.

Referring to FIGS. 1 and 2, the first protrusion member 3 may protrude from the winding member 2 in the first direction (FD arrow direction). Accordingly, when the metal foil 100 is wound around the winding member 2, the first protrusion member 3 may protrude from the metal foil 100 in the first direction (FD arrow direction) of the first axis direction (X-axis direction). When the metal foil core 1 according to the present disclosure around which the metal foil 100 is wound is accommodated in the accommodation device, the first protrusion member 3 may be supported by a first support part (not illustrated) of the accommodation device. The first support part may support a portion of the first protrusion member 3 disposed between one end 3*a* of the first protrusion member 3 and the other end 3*b* of the first protrusion member 3 in the first axis direction (X-axis direction). The one end 3*a* of the first protrusion member 3 may correspond to an end of the first protrusion member 3 facing the first direction (FD arrow direction). The other end 3*b* of the first protrusion member 3 may correspond to an end of the first protrusion member 3 facing the second direction (SD arrow direction). The other end 3*b* of the first protrusion member 3 may be connected to the winding member 2. The first protrusion member 3 may be formed to have a long length in the first axis direction (X-axis direction). For example, the first protrusion member 3 may be formed in a hollow cylindrical shape extending in the first axis direction (X-axis direction).

Referring to FIGS. 1 and 2, the second protrusion member 4 may protrude from the winding member 2 in the second direction (SD arrow direction). Accordingly, when the metal foil 100 is wound around the winding member 2, the second protrusion member 4 may protrude from the metal foil 100 in the second direction (SD arrow direction) of the first axis direction (X-axis direction). When the metal foil core 1 according to the present disclosure around which the metal foil 100 is wound is accommodated in the accommodation device, the second protrusion member 4 may be supported by a second support part (not illustrated) of the accommodation device. The second support part may support a portion of the second protrusion member 4 disposed between one end 4*a* of the second protrusion member 4 and the other end 4*b* of the second protrusion member 4 in the first axis direction (X-axis direction). The one end 4*a* of the second protrusion member 4 may correspond to an end of the second protrusion member 4 facing the second direction (SD arrow direction). The other end 4*b* of the second protrusion member 4 may correspond to an end of the second protrusion member 4 facing the first direction (FD arrow direction). The other end 4*b* of the second protrusion member 4 may be connected to the winding member 2. The second protrusion member 4 may be formed to have a long length in the first axis direction (X-axis direction). For example, the second protrusion member 4 may be formed in a hollow cylindrical shape extending in the first axis direction (X-axis direction).

Here, a load of the metal foil 100 may be continuously applied to the winding member 2 around which the metal foil 100 is wound during transportation. Further, as vibrations, shaking, impact, and the like generated during the transportation are transmitted to the metal foil core 1 according to the present disclosure, the winding member 2 may be deformed. In this way, in order to reduce sag, deformation, and the like generated in the winding member 2, the metal foil core 1 according to the present disclosure may include a first inducing groove 5.

Figure 3:
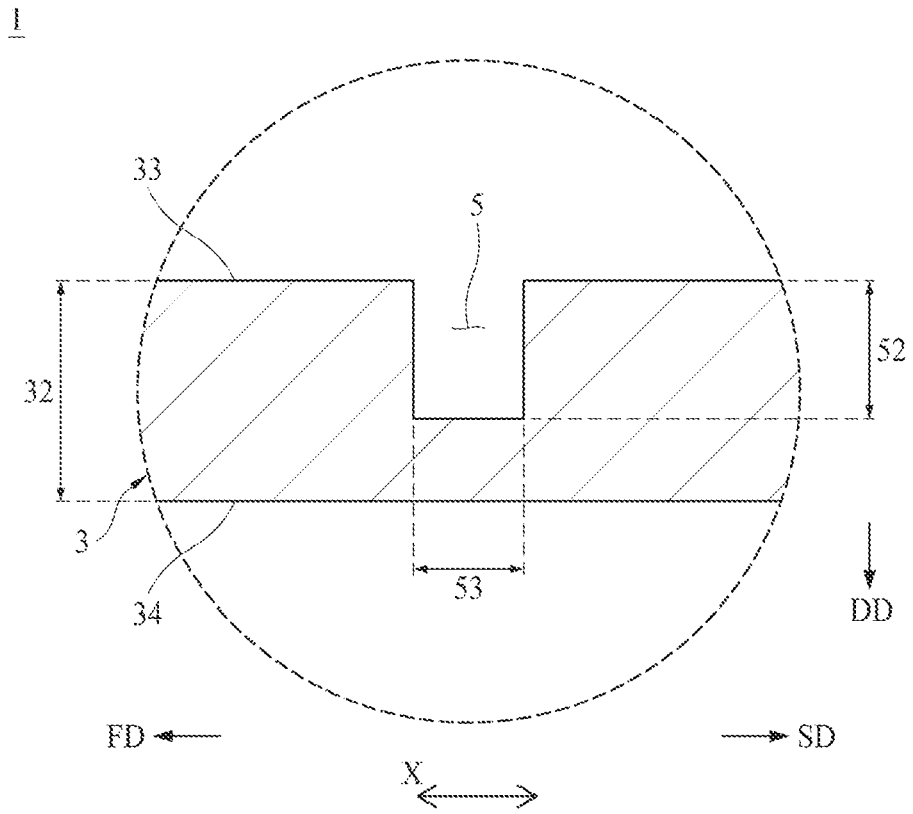
FIG. 3 is a schematic enlarged side cross-sectional view of part A of FIG. 2.

Referring to FIGS. 1 to 3, the first inducing groove 5 is formed in the first protrusion member 3. The first inducing groove 5 may be disposed between both ends 3*a* and 3*b* of the first protrusion member 3 in the first axis direction (X-axis direction). Accordingly, the metal foil core 1 according to the present disclosure may induce the sag, the deformation, and the like due to the load of the metal foil 100 and the vibrations, the shaking, the impact, and the like generated during the transportation to be intensively generated in a portion of the first protrusion member 3 in which the first inducing groove 5 is formed. For example, an angle, at which a portion of the first protrusion member 3 positioned in the first direction (FD arrow direction) from the first inducing groove 5 is tilted due to the sag, the deformation, and the like in the first axis direction (X-axis direction), may increase, and an angle, at which a portion of the first protrusion member 3 positioned in the second direction (SD arrow direction) from the first inducing groove 5 is tilted due to the sag, the deformation, and the like in the first axis direction (X-axis direction), may decrease. Thus, in the metal foil core 1 according to the present disclosure, since the sag, the deformation, and the like generated in the winding member 2 may be reduced, defects such as machine direction (MD) buckle and fusilli generated in the metal foil 100 wound around the winding member 2 can be reduced. Accordingly, the metal foil core 1 according to the present disclosure can contribute to improving the quality of the metal foil 100 that has been handled and transported completely and also contribute to improving the stability and ease of a handling operation and a transportation operation for the metal foil 100.

The first inducing groove 5 may be implemented as a groove formed in the first protrusion member 3 at a predetermined depth. A portion of the first protrusion member 3 in which the first inducing groove 5 is formed may be formed to have a thinner thickness than other portions of the first protrusion member 3. Thus, the metal foil core 1 according to the present disclosure induces the sag, the deformation, and the like to be intensively generated at the portion of the first protrusion member 3 in which the first inducing groove 5 is formed, and thus a defect rate for the metal foil 100 wound around the winding member 2 can be reduced.

The first inducing groove 5 may be formed in a circumferential direction of the first protrusion member 3. Accordingly, the metal foil core 1 according to the present disclosure may induce the sag, the deformation, and the like to be further intensively generated at the portion of the first protrusion member 3 in which the first inducing groove 5 is formed, and thus the defect rate for the metal foil 100 wound around the winding member 2 can be further reduced. The circumferential direction of the first protrusion member 3 may be a circumferential direction centered on the first axis direction (X-axis direction). The first inducing groove 5 may be formed to have a circular ring shape in the circumferential direction of the first protrusion member 3. Although not illustrated, a plurality of first inducing grooves 5 may be formed in the circumferential direction of the first protrusion member 3. In this case, the first inducing grooves 5 may be arranged to be spaced apart from each other in the circumferential direction of the first protrusion member 3.

Referring to FIGS. 1 to 4, the first inducing groove 5 may be disposed at a position corresponding to a position ratio PLLR in a range of 0.1 to 0.3. The position ratio PLLR may be calculated using Equation 1 below.

$$PLLR = \frac{AD}{PL} \quad \text{[Equation 1]}$$

In Equation 1, AD denotes a distance (hereinafter, referred to as a "first separation distance 51") by which the one end 3*a* of the first protrusion member 3 and the first inducing groove 5 are spaced apart from each other in the first axis direction (X-axis direction). In this case, when the first inducing groove 5 has a width in the first axis direction, the AD is a distance by which the one end 3*a* of the first protrusion member 3 and a center point of the width of the first inducing groove 5 are spaced apart from each other in the first axis direction (X-axis direction). PL denotes a length 31 (hereinafter, referred to as a "length 31 of the first protrusion member 3") of the first protrusion member 3 in the first axis direction (X-axis direction). The position ratio PLLR according to Equation 1 may correspond to a ratio of the first separation distance 51 to the length 31 of the first protrusion member 3.

Meanwhile, the position ratio PLLR may mean how the first inducing groove 5 is disposed close to the metal foil 100 wound around the winding member 2 as compared to the length 31 of the first protrusion member 3. As the position ratio PLLR decreases, the first inducing groove 5 is disposed farther from the metal foil 100 and is also disposed at a position closer to the one end 3*a* of the first protrusion member 3. As the position ratio PLLR increases, the first inducing groove 5 is disposed closer to the metal foil 100 and is also disposed at a position farther from the one end 3*a* of the first protrusion member 3.

As the first inducing groove 5 is disposed at a position corresponding to the position ratio PLLR in a range of 0.1 to 0.3, in the metal foil core 1 according to the present disclosure, the defect rate for the metal foil 100 wound around the winding member 2 can be reduced without self-damage or deformation. This can be identified through experimental results of FIG. 4. The experimental results of FIG. 4 were derived by evaluating defects generated in the metal foil core and the metal foil 100 after the metal foil 100 was transported using the same transportation unit during the same transportation time in a state in which the metal foil 100 was wound around a metal foil core according to examples and comparative examples and accommodated in the accommodation device. In FIG. 4, the metal foil core 1 according to examples and comparative examples except for comparative example 1 included the first inducing groove 5 and a second inducing groove 6. In this case, the second inducing groove 6 may be formed in the second protrusion member 4 in the same shape and size as those of the first inducing groove 5. The position of the second inducing groove 6 in the second protrusion member 4 and the position of the first inducing groove 5 in the first protrusion member 3 may be symmetrical to each other.

First, in comparative example 1, there was no first inducing groove 5. As a result of the experiment, a state thereof was good, but defects such as fusilli and MD buckle occurred in the metal foil 100.

Next, in examples 1 to 4, the first inducing groove 5 was disposed at a position corresponding to the position ratio PLLR in a range of 0.1 to 0.3. As a result of the experiment, a state thereof was good, and a state of the metal foil 100 was also good. Thus, it can be identified from the experimental results of examples 1 to 4 and comparative example 1 that, when the first inducing groove 5 was disposed at a position corresponding to the position ratio PLLR in a range of 0.1 to 0.3, damage or deformation of the metal foil core 1 itself according to the present disclosure might decrease, and also the defect rate for the metal foil 100 might be reduced.

Next, in comparative example 2, the first inducing groove 5 was disposed at a position corresponding to the position ratio PLLR of 0.05. As a result of the experiment, a state thereof was good, but defects such as fusilli and MD buckle occurred in the metal foil 100. In the case of comparative example 2, as the first inducing groove 5 was disposed too close to the one end 3*a* of the first protrusion member 3, the sag, the deformation, and the like were not concentrated on the portion of the first protrusion member 3 in which the first inducing groove 5 is formed and were transmitted to the winding member 2, and thus the defects occurred in the metal foil 100. Thus, it can be identified from the experimental results of comparative example 2 and examples 1 and 2 that, when the first inducing groove 5 was disposed at a position corresponding to the position ratio PLLR that is smaller than 0.1, the defect rate for the metal foil 100 cannot be reduced, and only when the first inducing groove 5 was disposed at a position corresponding to the position ratio PLLR that is greater than or equal to 0.1, the defect rate for the metal foil 100 can be reduced.

Next, in comparative example 3, the first inducing groove 5 was disposed at a position corresponding to the position ratio PLLR of 0.4. As a result of the experiment, a state thereof was good, but the metal foil 100 was separated. In the case of comparative example 3, as the first inducing groove 5 was disposed too close to the metal foil 100, the portion of the first protrusion member 3 on which the sag, the deformation, and the like were concentrated was disposed too close to the metal foil 100, and thus the metal foil 100 was separated from the winding member 2. Thus, it can be identified from the experimental results of comparative example 3 and examples 3 and 2 that, when the first inducing groove 5 was disposed at a position corresponding to the position ratio PLLR that is greater than 0.3, defects might occur as the metal foil 100 was separated, and only when the first inducing groove 5 was disposed at a position corresponding to the position ratio PLLR that is smaller than or equal to 0.3, the defect rate might be reduced while the separation of the metal foil 100 is prevented.

It can be identified from the experimental results of examples 1 to 4 and comparative examples 1 to 3 that, in the metal foil core 1 according to the present disclosure, when the first inducing groove 5 was disposed at a position corresponding to the position ratio PLLR in a range of 0.1 to 0.3, the defect rate for the metal foil 100 wound around the winding member 2 might be reduced without self-damage or deformation. Thus, using the first inducing groove 5, the metal foil core 1 according to the present disclosure may contribute to improving the quality of the metal foil 100 that has been handled and transported completely and also contribute to improving the stability and ease of a handling operation and a transportation operation for the metal foil 100.

Meanwhile, in Equation 1, the length 31 of the first protrusion member 3 may be calculated using Equation 2.

$$PL=(TL-WL)\div 2 \quad \text{[Equation 2]}$$

In Equation 2, TL denotes a total length 11 (hereinafter, referred to as a "total length 11") of the metal foil core 1 according to the present disclosure in the first axis direction (X-axis direction). The total length 11 may be the same as the sum of the length 31 of the first protrusion member 3, a length 21 of the winding member 2, and a length 41 of the second protrusion member 4 in the first axis direction (X-axis direction). WL denotes the length 21 (hereinafter, referred to as a "length 21 of the winding member 2") of the winding member 2 in the first axis direction (X-axis direction). According to Equation 2, the position ratio PLLR may be calculated on the assumption that the length 31 of the first protrusion member 3 and the length 41 of the second protrusion member 4 are equal to each other. The length 31 of the first protrusion member 3 may also be acquired through measurement using a measurement tool or a measurement apparatus.

Meanwhile, the length 21 of the winding member 2 may be the same as the width of the metal foil 100 wound around the winding member 2. The length 21 of the winding member 2 may be calculated by subtracting the length 31 of the first protrusion member 3 and the length 41 of the second protrusion member 4 from the total length 11. The length 21 of the winding member 2 may also be acquired through measurement using a measurement tool or a measurement apparatus.

Meanwhile, the total length 11 may be calculated by summing the length 31 of the first protrusion member 3, the length 21 of the winding member 2, and the length 41 of the second protrusion member 4. The total length 11 may also be acquired through measurement using a measurement tool or a measurement apparatus. In the metal foil core 1 according to the present disclosure, the total length 11 may be implemented in a range of 300 mm to 2,000 mm.

The first inducing groove 5 may be disposed at a position spaced a distance of 20 mm to 150 mm from the one end 3*a* of the first protrusion member 3 in the first axis direction (X-axis direction). That is, the first separation distance 51 may be in a range of 20 mm to 150 mm. When the first separation distance 51 is smaller than 20 mm, as the first inducing groove 5 is disposed too close to the one end 3*a* of the first protrusion member 3, the sag, the deformation, and the like are not concentrated on the portion of the first protrusion member 3 in which the first inducing groove 5 is formed and are transmitted to the winding member 2, and thus the defects may occur in the metal foil 100. When the first separation distance 51 is greater than 150 mm, as the first inducing groove 5 is disposed too close to the metal foil 100, the portion of the first protrusion member 3 on which the sag, the deformation, and the like are concentrated is disposed too close to the metal foil 100, and thus the metal foil 100 may be separated from the winding member 2. In consideration of this, in the metal foil core 1 according to the present disclosure, the first separation distance 51 is implemented in a range of 20 mm to 150 mm, and thus the defect rate can be reduced while the separation of the metal foil 100 is prevented.

Referring to FIGS. 1 to 4, the first inducing groove 5 may be disposed at a depth corresponding to a depth ratio PDTR in a range of 0.1 to 0.5. The depth ratio PDTR may be calculated using Equation 3 below.

$$PDTR = \frac{GD}{PD} \quad \text{[Equation 3]}$$

In Equation 3, PD denotes a thickness 32 of the first protrusion member 3. When the first protrusion member 3 is formed in a hollow cylindrical shape, the thickness 32 of the first protrusion member 3 may be a thickness of the remaining portion except for the hollow portion. GD denotes a depth 52 of the first inducing groove 5. The depth 52 of the first inducing groove 5 is based on a cross-sectional direction perpendicular to the first axis direction (X-axis direction). The depth ratio PDTR according to Equation 3 may correspond to a ratio of the depth 52 of the first inducing groove 5 to the thickness 32 of the first protrusion member 3.

Meanwhile, the depth ratio PDTR may indicate how deep the first inducing groove 5 is formed as compared to the thickness 32 of the first protrusion member 3. As the depth ratio PDTR decreases, the first inducing groove 5 may be formed to have a shallower depth as compared to the thickness 32 of the first protrusion member 3. As the depth ratio PDTR increases, the first inducing groove 5 may be formed to have a deeper depth as compared to the thickness 32 of the first protrusion member 3.

As the first inducing groove 5 is disposed to have a depth corresponding to the depth ratio PDTR in a range of 0.1 to 0.5, in the metal foil core 1 according to the present disclosure, the defect rate for the metal foil 100 wound around the winding member 2 can be reduced without self-damage or deformation. This can be identified through an experimental result of FIG. 4.

First, in comparative example 1, there was no first inducing groove 5. As a result of the experiment, a state thereof was good, but defects such as fusilli and MD buckle occurred in the metal foil 100.

Next, in examples 1 to 4, the first inducing groove 5 was disposed to have a depth corresponding to the depth ratio PDTR in a range of 0.1 to 0.5. As a result of the experiment, a state thereof was good, and a state of the metal foil 100 was also good. Thus, it can be identified from the experimental results of examples 1 to 4 and comparative example 1 that, when the first inducing groove 5 was formed to have a depth corresponding to the depth ratio PDTR in a range of 0.1 to 0.5, the damage or deformation of the metal foil core 1 itself according to the present disclosure can be decreased, and the defect rate for the metal foil 100 can be reduced.

Next, in comparative example 4, the first inducing groove 5 was formed to have a depth corresponding to the depth ratio PDTR of 0.05. As a result of the experiment, a state thereof was good, but defects such as fusilli and MD buckle occurred in the metal foil 100. In the case of comparative example 4, as the first inducing groove 5 was formed to have too shallow depth as compared to the thickness 32 of the first protrusion member 3, the sag, the deformation, and the like were not concentrated on the portion of the first protrusion member 3 in which the first inducing groove 5 is formed and were transmitted to the winding member 2, and thus the defects occurred in the metal foil 100. Thus, it can be identified from the experimental results of comparative example 4 and example 1 that, when the first inducing groove 5 was formed to have a depth corresponding to the depth ratio PDTR that is smaller than 0.1, it was difficult to reduce the defect rate for the metal foil 100, and only when the first inducing groove 5 was formed to have a depth corresponding to the depth ratio PDTR that is greater than or equal to 0.1, the defect rate for the metal foil 100 can be reduced.

Next, in comparative example 5, the first inducing groove 5 was formed to have a depth corresponding to the depth ratio PDTR of 0.7, and as a result of performing the experiment, the metal foil core was damaged. In the case of comparative example 5, as the first inducing groove 5 was formed to have too deeper depth as compared to the thickness 32 of the first protrusion member 3, the rigidity of the metal foil core was too weak, and thus the metal foil core was damaged. As the metal foil core was damaged, the metal foil 100 was defective to the extent that fusilli defects and MD buckle defects could not be evaluated. Thus, it can be identified from the experimental results of comparative example 5 and example 4 that, when the first inducing groove 5 was formed to have a depth corresponding to the depth ratio PDTR that is greater than 0.5, the metal foil core might be damaged, and only when the first inducing groove 5 was formed to have a depth corresponding to the depth ratio PDTR that is smaller than or equal to 0.5, the defect rate for the metal foil 100 can be reduced while the damage to the metal foil core is prevented.

It can be identified from the experimental results of examples 1 to 4 and comparative examples 1, 4, and 5 that, in the metal foil core 1 according to the present disclosure, as the first inducing groove 5 was formed to have a depth corresponding to the depth ratio PDTR in a range of 0.1 to 0.5, the defect rate for the metal foil 100 wound around the winding member 2 can be reduced without self-damage or deformation. Thus, using the first inducing groove 5, the metal foil core 1 according to the present disclosure can contribute to improving the quality of the metal foil 100 that has been handled and transported completely and also contribute to improving the stability and ease of a handling operation and a transportation operation for the metal foil 100. The thickness 32 of the first protrusion member 3 may be in a range of 3 mm to 100 mm. In this case, the total length 11 may be in a range of 300 mm to 2,000 mm.

Meanwhile, in Equation 3, the thickness 32 of the first protrusion member 3 may be calculated using Equation 4.

$$PD=(OD-ID)\div 2 \quad \text{[Equation 4]}$$

In Equation 4, OD denotes an outer diameter 321 of the first protrusion member 3, and ID denotes an inner diameter 322 of the first protrusion member 3. According to Equation 4, the depth ratio PDTR may be calculated on the assumption that the first protrusion member 3 is formed to have the same thickness 32 in the circumferential direction. The thickness 32 of the first protrusion member 3 may also be acquired through measurement using a measurement tool or a measurement apparatus. The inner diameter 322 of the first protrusion member 3 may be in a range of 24 mm to 200 mm. In this case, the thickness 32 of the first protrusion member 3 may be in a range of 3 mm to 100 mm, and the total length 11 may be in a range of 300 mm to 2,000 mm.

The first inducing groove 5 may be formed to have a depth 52 in a range of 3 mm to 15 mm. When the depth 52 of the first inducing groove 5 is smaller than 3 mm, as the first inducing groove 5 is formed to have too shallow depth, the sag, the deformation, and the like are not concentrated on the portion of the first protrusion member 3 in which the first inducing groove 5 is formed and are transmitted to the winding member 2, and thus the defects may occur in the metal foil 100. When the depth 52 of the first inducing groove 5 is greater than 15 mm, as the first inducing groove 5 is formed to have too deeper depth, the strength of the first protrusion member 3 becomes too small, and thus the metal foil core 1 according to the present disclosure may be damaged. In consideration of this, in the metal foil core 1 according to the present disclosure, the depth 52 of the first inducing groove 5 is implemented in a range of 3 mm to 15 mm, and thus the defect rate can be reduced while the self-damage is prevented and the separation of the metal foil 100 is prevented.

Meanwhile, the depth 52 of the first inducing groove 5 may be greater than a thickness of the metal foil 100 wound around the winding member 2. For example, when the thickness of the metal foil 100 is in a range of 0.2 μm to 5 mm, the depth 52 of the first inducing groove 5 may be greater than 5 mm.

Referring to FIGS. 1 to 4, a width 53 of the first inducing groove 5 may be smaller than the depth 52 thereof. In this case, the width 53 of the first inducing groove 5 is smaller than the depth 52 of the first inducing groove 5. The width 53 of the first inducing groove 5 is based on the first axis direction (X-axis direction). When the width 53 of the first inducing groove 5 is greater than the depth 52 of the first inducing groove 5, the strength of the portion of the first protrusion member 3 in which the first inducing groove 5 is formed is too weak, and thus the first protrusion member 3 may be damaged or deformed. Thus, in the metal foil core 1 according to the present disclosure, the width of the first inducing groove 5 is smaller than the depth 52 of the first inducing groove 5, and thus the defect rate for the metal foil 100 can be reduced while the first protrusion member 3 is prevented from being damaged or deformed.

The depth 52 of the first inducing groove 5 may be two times the width 53 of the first inducing groove 5. In this case, a ratio (hereinafter, referred to as a "first width ratio") of the width to the processing depth of the first inducing groove 5 may be 0.5. The first width ratio may be calculated by dividing the width 53 of the first inducing groove 5 by the depth 52 of the first inducing groove 5. Meanwhile, the first width ratio may mean how wide the width 53 is formed as compared to the depth 52 of the first inducing groove 5. As the first width ratio decreases, the first inducing groove 5 may be formed to have a small width as compared to the depth 52 thereof. As the first width ratio increases, the first inducing groove 5 may be formed to have a large width as compared to the depth 52 thereof.

As the first inducing groove 5 is formed to have the first width ratio of 0.5, in the metal foil core 1 according to the present disclosure, the defect rate for the metal foil 100 wound around the winding member 2 can be reduced without the self-damage or deformation. This can be identified through an experimental result of FIG. 4.

First, in comparative example 1, there was no first inducing groove 5. As a result of the experiment, a state thereof was good, but defects such as fusilli and MD buckle occurred in the metal foil 100.

Next, in examples 1 to 4, the first inducing groove 5 was formed to have the first width ratio of 0.5. As a result of the experiment, a state thereof was good, and a state of the metal foil 100 was also good. Thus, it can be identified from the experimental results of examples 1 to 4 and comparative example 1 that, when the first inducing groove 5 was formed to have the first width ratio of 0.5, damage or deformation of the metal foil core 1 itself according to the present disclosure might decrease, and the defect rate for the metal foil 100 might be reduced.

Next, in comparative example 6, the first inducing groove 5 was formed to have the first width ratio of 0.3. As a result of the experiment, a state thereof was good, but defects such as fusilli and MD buckle occurred in the metal foil 100. In the case of comparative example 6, as the first inducing groove 5 was formed to have too narrow width 53 as compared to the depth 52, the sag, the deformation, and the like were not concentrated on the portion of the first protrusion member 3 in which the first inducing groove 5 is formed and were transmitted to the winding member 2, and thus the defects occurred in the metal foil 100. Thus, it can be identified from the experimental results of comparative example 6 and examples 1 to 4 that, when the first inducing groove 5 was formed to have the first width ratio that is smaller than 0.5, it was difficult to reduce the defect rate for the metal foil 100, and only when the first inducing groove 5 was formed to have the first width ratio of 0.5, the defect rate for the metal foil 100 can be reduced.

Next, in comparative example 7, the first inducing groove 5 was formed to have the first width ratio of 0.7, and as a result of the experiment, the metal foil core was deformed. In the case of comparative example 7, as the first inducing groove 5 was formed to have too large width as compared to the depth 52 of the first inducing groove 5, the rigidity of the metal foil core was too weak, and thus the metal coil core was deformed. As the metal foil core was deformed, fusilli defects and MD buckle defects occurred even in the metal foil 100. Thus, it can be identified from the experimental results of comparative example 7 and example 4 that, when the first inducing groove 5 was formed to have the first width ratio that is greater than 0.5, the metal foil core might be damaged, and only when the first inducing groove 5 was formed to have the first width ratio of 0.5, the defect rate for the metal foil 100 might be reduced while the damage to the metal foil core is prevented.

It can be identified from the experimental results of examples 1 to 4 and comparative examples 1, 6, and 7 that, in the metal foil core 1 according to the present disclosure, as the first inducing groove 5 was formed to have the first width ratio of 0.5, the defect rate for the metal foil 100 wound around the winding member 2 might be reduced without self-damage or deformation. Thus, using the first inducing groove 5, the metal foil core 1 according to the present disclosure may contribute to improving the quality of the metal foil 100 that has been handled and transported completely and also contribute to improving the stability and ease of a handling operation and a transportation operation for the metal foil 100.

Referring to FIGS. 3 and 5 to 9, the metal foil core 1 according to the present disclosure may include various embodiments related to the first inducing groove 5. These embodiments may be formed such that the position ratio PLLR, the depth ratio PDTR, the first width ratio, and the like are satisfied. Hereinafter, embodiments of the first inducing groove 5 will be sequentially described with reference to the accompanying drawings.

Referring to FIG. 3, the first inducing groove 5 according to a first embodiment may be formed to extend while maintaining a uniform size in a depth direction (DD arrow direction). In this case, the first inducing groove 5 according to the first embodiment may extend while maintaining a uniform width in the depth direction (DD arrow direction). For example, the first inducing groove 5 according to the first embodiment may be formed to have a rectangular cross section based on the cross-sectional direction. When the first inducing groove 5 according to the present disclosure is formed in an outer surface 33 of the first protrusion member 3, the depth direction (DD arrow direction) may be a direction from the outer surface 33 of the first protrusion member 3 toward an inner surface 34 of the first protrusion member 3. The outer surface 33 of the first protrusion member 3 is a reference surface for the outer diameter 321 of the first protrusion member 3. The inner surface 34 of the first protrusion member 3 is a reference surface for the inner diameter 322 of the first protrusion member 3.

Figure 5:
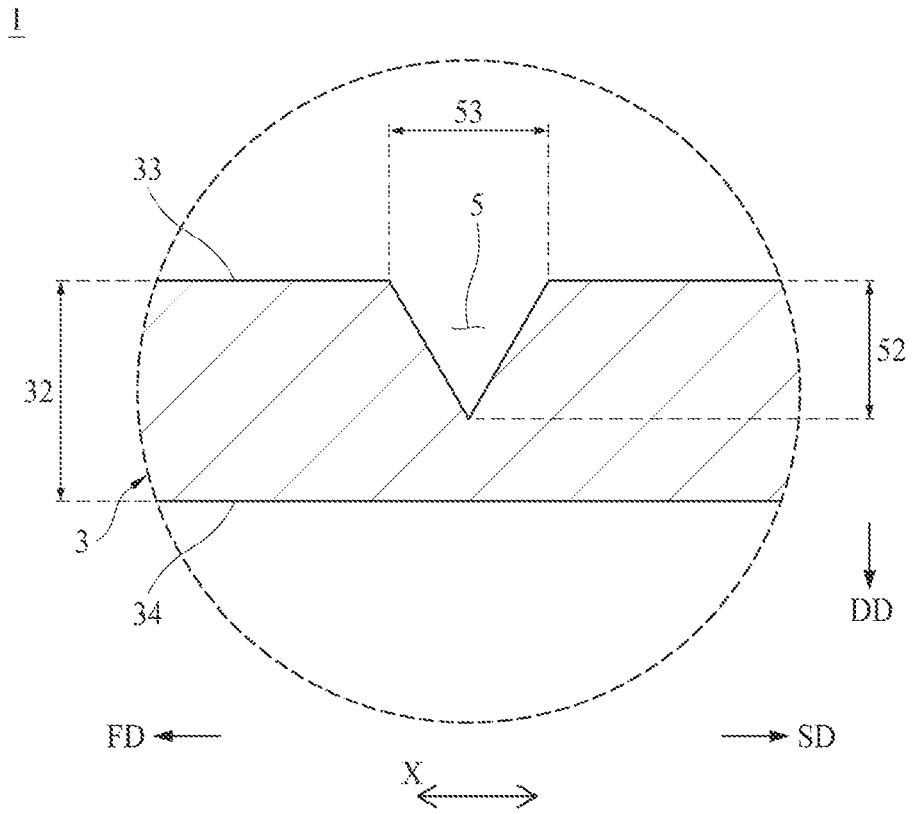
FIGS. 5 to 10 are schematic enlarged side cross-sectional views illustrating embodiments of a first inducing groove of the metal foil core in part A of FIG. 2 according to the present disclosure.
Figure 6:
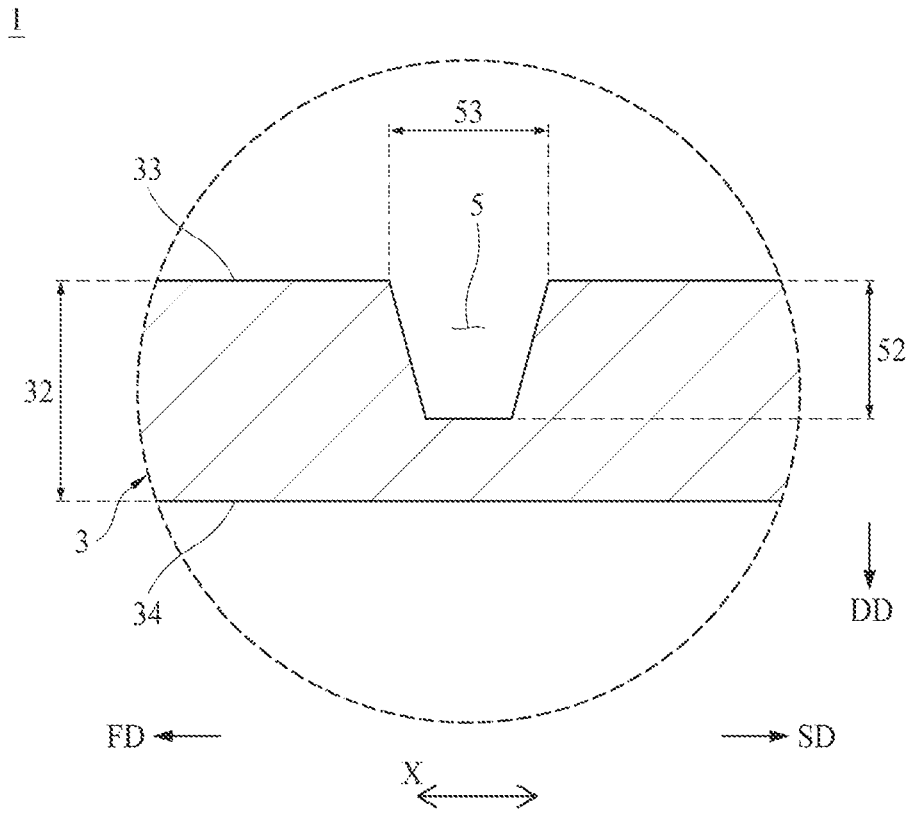

Referring to FIGS. 5 and 6, the first inducing groove 5 according to a second embodiment may be formed such that the size thereof decreases as the first inducing groove 5 extends in the depth direction (DD arrow direction). In this case, the first inducing groove 5 according to the second embodiment may be formed such that the width thereof decreases as the first inducing groove 5 extends in the depth direction (DD arrow direction). As illustrated in FIG. 5, the first inducing groove 5 according to the second embodiment may be formed such that the size thereof decreases as the first inducing groove 5 extends in the depth direction (DD arrow direction) and a sharp tip is formed at an end thereof. For example, the first inducing groove 5 according to the second embodiment may be formed to have a triangular cross section in which the size thereof decreases as the first inducing groove 5 extends in the depth direction (DD arrow direction) based on the cross-sectional direction. As illustrated in FIG. 6, the first inducing groove 5 according to the second embodiment may be formed such that the size thereof decreases as the first inducing groove 5 extends in the depth direction (DD arrow direction) and a flat surface is formed to be tapered at an end thereof. For example, the first inducing groove 5 according to the second embodiment may be formed to have a trapezoidal cross section in which the size thereof decreases as the first inducing groove 5 extends in the depth direction (DD arrow direction) based on the cross-sectional direction.

In this way, in the first inducing groove 5 according to the second embodiment in which the size thereof decreases as the first inducing groove 5 extends from the outer surface 33 of the first protrusion member 3 in the depth direction (DD arrow direction), the width 53 may be based on a portion of the first inducing groove 5 in contact with the outer surface 33 of the first protrusion member 3. In this case, the maximum width of the first inducing groove 5 according to the second embodiment may correspond to the width 53.

Figure 7:
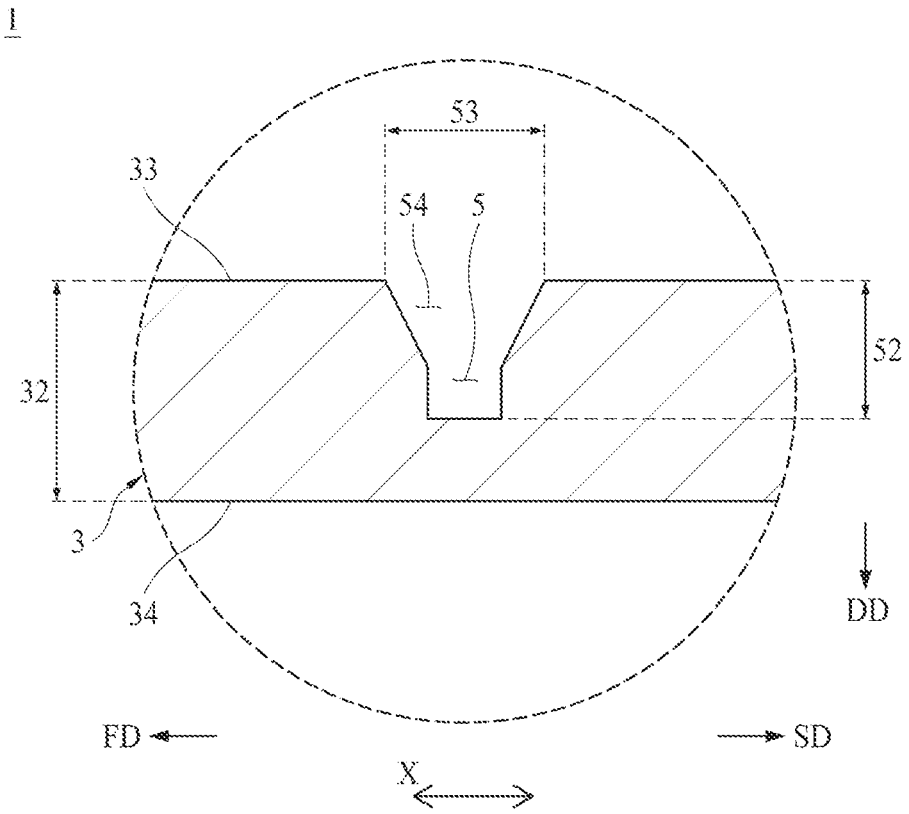
Figure 8:
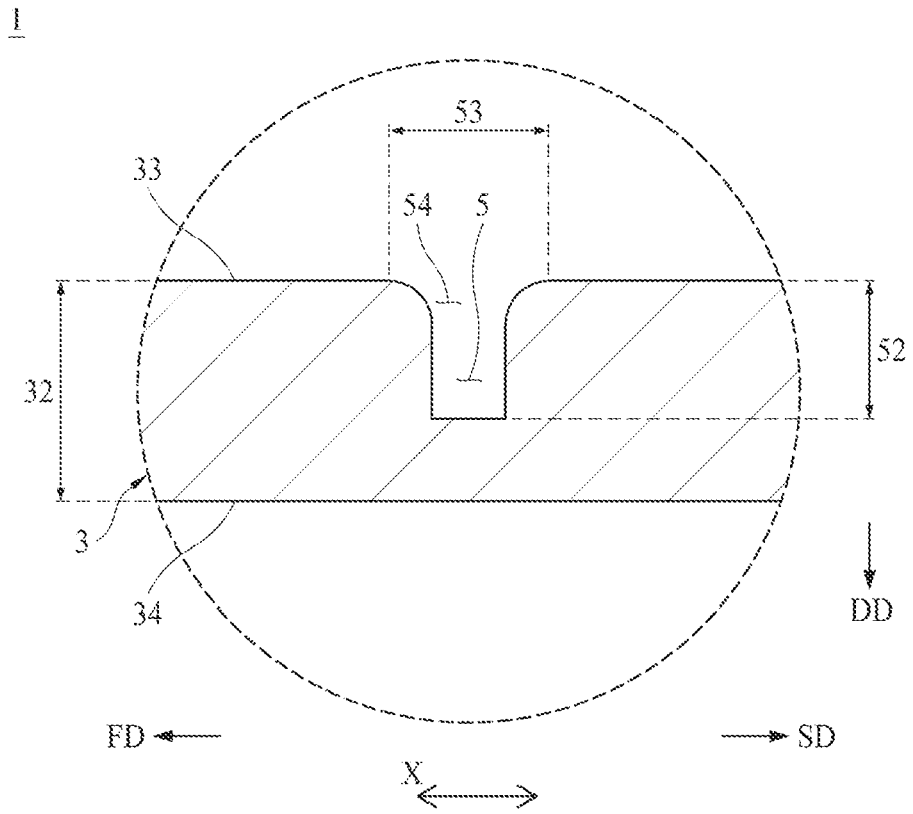

Referring to FIGS. 7 and 8, the first inducing groove 5 according to the third embodiment may include a first corner groove 54. When the first inducing groove 5 according to the third embodiment is formed in the outer surface 33 of the first protrusion member 3, the first corner groove 54 may be formed at a corner connected to the outer surface 33 of the first protrusion member 3. The first corner grove 54 may be formed such that the size thereof decreases as the first corner groove 54 extends in the depth direction (DD arrow direction). The remaining portion of the first inducing groove 5 except for a portion in which the first corner groove 54 is formed according to the third embodiment may be formed to extend while maintaining a uniform size in the depth direction (DD arrow direction). In this case, the portion of the first inducing groove 5 according to the third embodiment in which the first corner groove 54 is formed such that the width thereof decreases as the first inducing groove 5 extends in the depth direction (DD arrow direction), and the remaining portion thereof except for the portion in which the first corner groove 54 is formed may extend while maintaining a uniform width in the depth direction (DD arrow direction).

As illustrated in FIG. 7, the portion of the first inducing groove 5 according to the third embodiment in which the first corner groove 54 is formed may form an inclined surface. In this case, the portion of the first protrusion member 3 in which the first corner groove 54 is formed may form an inclined surface. For example, the first inducing groove 5 according to the third embodiment may be formed to have a trapezoidal cross section in which the size of the portion in which the first corner groove 54 is formed based on the cross-sectional direction decreases as the first inducing groove 5 extends in the depth direction (DD arrow direction), and the remaining portion except for the portion in which the first corner groove 54 is formed may be formed to have a quadrangular cross section. The first corner groove 54 may be formed in the outer surface 33 or the inner surface 34 of the first protrusion member 3.

As illustrated in FIG. 8, the portion of the first inducing groove 5 according to the third embodiment in which the first corner groove 54 is formed may form a curved surface. In this case, the portion of the first protrusion member 3 in which the first corner groove 54 is formed may form a curved surface. The portion of the first protrusion member 3 in which the first corner groove 54 is formed may be formed to form a curved surface that is convex toward the first corner groove 54. For example, the first inducing groove 5 according to the third embodiment may be formed to have a trapezoidal cross section in which, as the first inducing groove 5 extends in the depth direction (DD arrow direction), the size of the portion in which the first corner groove 54 is formed based on the cross-sectional direction decreases, and thus a concave curved surface is formed, and the remaining portion except for the portion in which the first corner groove 54 is formed may be formed to have a quadrangular cross section.

Figure 9:
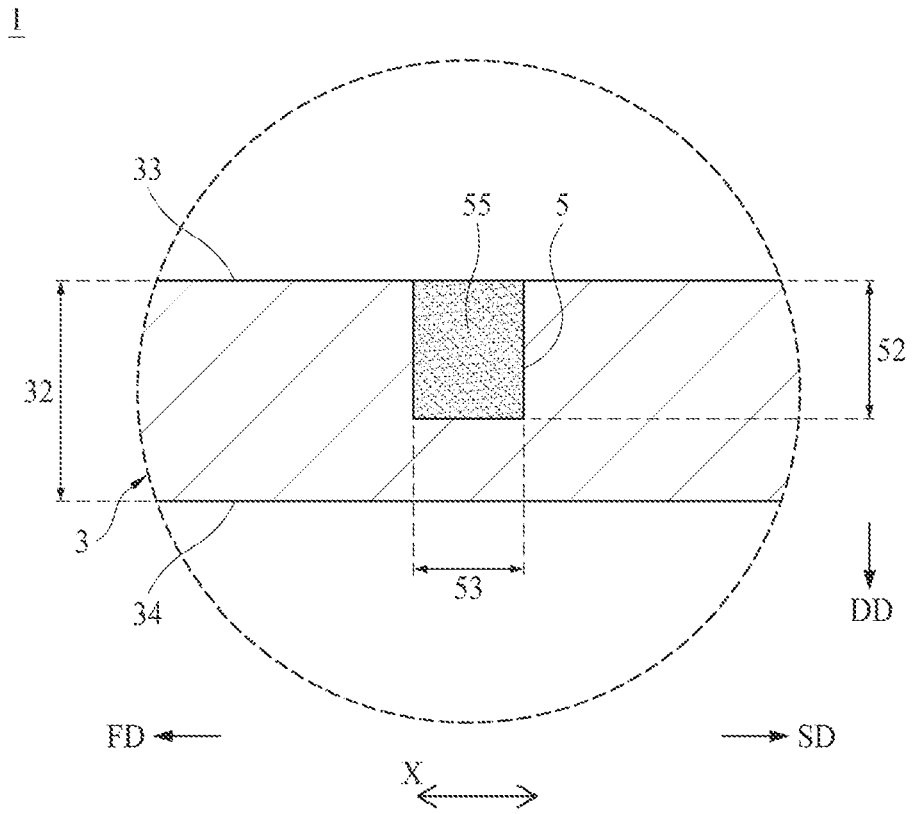

Referring to FIG. 9, a first buffer member 55 may be inserted into the first inducing groove 5 according to the fourth embodiment. The first buffer member 55 may be made of an elastically deformable material. For example, the first buffer member 55 may be formed of rubber, urethane, or the like. The first buffer member 55 may buffer or absorb the sag, the deformation, and the like generated at portions of the first protrusion member 3 in which the first inducing groove 5 according to the fourth embodiment is formed, and thus can reduce the degree to which an impact due to the corresponding sag, the corresponding deformation, and the like is transmitted to the metal foil 100. The first buffer member 55 may be formed to have the same shape as the first inducing groove 5 according to the fourth embodiment. FIG. 9 illustrates the first inducing groove 5 and the first buffer member 55 according to the fourth embodiment that are formed to have a rectangular cross section based on the cross-sectional direction, but the present disclosure is not limited thereto, and the first inducing groove 5 and the first buffer member 55 according to the fourth embodiment may be formed to have a triangular cross section as illustrated in FIG. 5, to have a trapezoidal cross section as illustrated in FIG. 6, to have a cross section in which a trapezoidal shape and a quadrangular shape are combined as illustrated in FIG. 7, and to have a cross section in which a trapezoidal shape having a concave outer surface and a quadrangular shape are combined as illustrated in FIG. 8, based on the cross-sectional direction.

As illustrated in FIGS. 2, 3, and 5 to 9, the first inducing groove 5 may be formed in the outer surface 33 of the first protrusion member 3. In this case, the first inducing groove 5 may be formed as a groove extending from the outer surface 33 of the first protrusion member 3 toward the inner surface 34 of the first protrusion member 3 in the depth direction (DD arrow direction).

Figure 10:
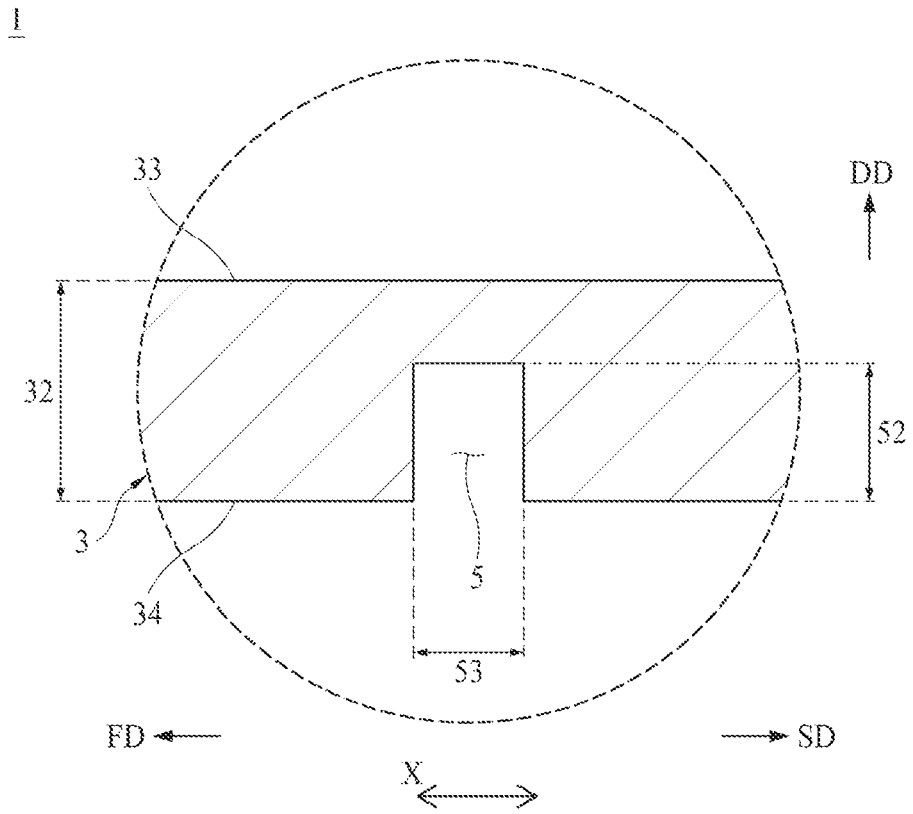
Figure 11:
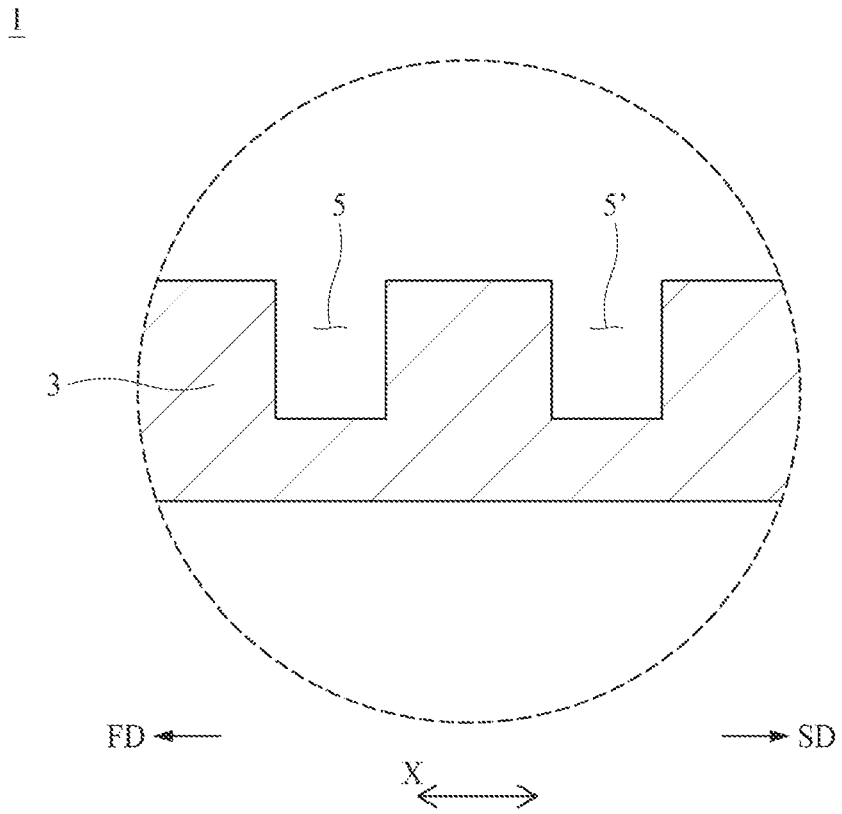
FIG. 11 is a schematic side cross-sectional view illustrating an embodiment in which a plurality of first inducing grooves are formed based on FIG. 3.

Referring to FIG. 10, the first inducing groove 5 may be formed in the inner surface 34 of the first protrusion member 3. In this case, the first inducing groove 5 may be formed as a groove extending from the inner surface 34 of the first protrusion member 3 toward the outer surface 33 of the first protrusion member 3 in the depth direction (DD arrow direction). As compared to a case in which the first inducing groove 5 is formed in the outer surface 33 of the first protrusion member 3, when the first inducing groove 5 is formed in the inner surface 34 of the first protrusion member 3, a larger moment of inertia may be obtained, and thus the metal foil core 1 according to the present disclosure may have higher rigidity. Meanwhile, the first to fourth embodiments described above may be applied to the first inducing groove 5 formed in the inner surface 34 of the first protrusion member 3. This may be easily derived by those skilled in the art from the description of the first embodiment to the fourth embodiment, and thus a detailed description thereof will be omitted.

Referring to FIGS. 1 to 11, the metal foil core 1 according to the present disclosure may include the plurality of first inducing grooves 5. The first inducing grooves 5 and 5' may be spaced apart from each other in the first axis direction (X-axis direction). Accordingly, in the metal foil core 1 according to the present disclosure, the sag, the deformation, and the like may be distributed to the portions of the first protrusion member 3 in which the first inducing grooves 5 and 5' are formed. Thus, in the metal foil core 1 according to the present disclosure, a risk of damage to the first protrusion member 3 can be further reduced even while the defect rate for the metal foil 100 can be reduced. The first inducing grooves 5 and 5' may be formed in the outer surface 33 of the first protrusion member 3 or the inner surface 34 of the first protrusion member 3. The first inducing grooves 5 and 5' may be formed in both the outer surface 33 of the first protrusion member 3 and the inner surface 34 of the first protrusion member 3.

Referring to FIGS. 1 to 12, the metal foil core 1 according to the present disclosure may include the second inducing groove 6.

The second inducing groove 6 is formed in the second protrusion member 4. The second inducing groove 6 may be disposed between both ends 4*a* and 4*b* of the second protrusion member 4 in the first axis direction (X-axis direction). Accordingly, the metal foil core 1 according to the present disclosure may induce, using the second inducing groove 6 and the first inducing groove 5, the sag, the deformation, and the like due to the load of the metal foil 100 and the vibrations, the shaking, the impact, and the like generated during the transportation to intensively occur in a portion of the second protrusion member 4 in which the second inducing groove 6 is formed and a portion of the first protrusion member 3 in which the first inducing groove 5 is formed. In this case, the sag, the deformation, and the like, which substantially coincide with each other, may occur in the portion of the second protrusion member 4 in which the second inducing groove 6 is formed and the portion of the first protrusion member 3 in which the first inducing groove 5 is formed. Thus, in the metal foil core 1 according to the present disclosure, an angle, at which the winding member 2 is inclined in the first axis direction (X-axis direction) due to the sag, the deformation, and the like, may decrease, and thus the defect rate for the metal foil 100 can be reduced.

The second inducing groove 6 may be implemented as a groove formed in the second protrusion member 4 at a predetermined depth. The portion of the second protrusion member 4 in which the second inducing groove 6 is formed may be formed to have a thinner thickness than the other portions of the second protrusion member 4. Thus, the metal foil core 1 according to the present disclosure may induce the sag, the deformation, and the like to be intensively generated in the portion of the second protrusion member 4 in which the second inducing groove 6 is formed.

The second inducing groove 6 may be formed in a circumferential direction of the second protrusion member 4. Accordingly, the metal foil core 1 according to the present disclosure may induce the sag, the deformation, and the like to be further intensively generated at the portion of the second protrusion member 4 in which the second inducing groove 6 is formed, and thus the defect rate for the metal foil 100 wound around the winding member 2 may be further reduced. The circumferential direction of the second protrusion member 4 may be a circumferential direction centered on the first axis direction (X-axis direction). The second inducing groove 6 may be formed to have a circular ring shape in the circumferential direction of the second protrusion member 4. Although not illustrated, a plurality of second inducing grooves 6 may be formed in the circumferential direction of the second protrusion member 4. In this case, the second inducing grooves 6 may be arranged to be spaced apart from each other in the circumferential direction of the second protrusion member 4.

A distance 61 (see FIG. 2; hereinafter, referred to as a second separation distance 61) by which the second inducing groove 6 is spaced apart from the one end 4*a* of the second protrusion member 4 in the second direction (SD arrow direction) and the first separation distance may be implemented to be identical to each other. Accordingly, the metal foil core 1 according to the present disclosure may induce the sag, the deformation, and the like, which substantially coincide with each other, to occur on both sides of the winding member 2. Thus, in the metal foil core 1 according to the present disclosure, an angle, at which the winding member 2 is inclined in the first axis direction (X-axis direction), may further decrease, and thus the defect rate for the metal foil 100 may be further reduced.

The second inducing groove 6 may be disposed at a position corresponding to the position ratio in a range of 0.1 to 0.3. The position ratio of the second inducing groove 6 may be calculated using Equation 1. In this case, in Equation 1, AD denotes the second separation distance 61, and PL denotes the length 41 (hereinafter, referred to as the "length 41 of the second protrusion member 4") of the second protrusion member 4 in the first axis direction (X-axis direction). The position ratio PLLR according to Equation 1 may correspond to a ratio of the second separation distance 61 to the length 41 of the second protrusion member 4. The position ratio of the second inducing groove 6 and the position ratio of the first inducing groove 5 may be implemented to be the same. Meanwhile, in the position ratio of the second inducing groove 6, the length 41 of the second protrusion member 4 may be calculated using Equation 2. The length 41 of the second protrusion member 4 and the length 31 of the first protrusion member 3 may be implemented to be the same.

The second inducing groove 6 may be disposed at a position spaced a distance of 20 mm to 150 mm from the one end 4*a* of the second protrusion member 4 in the first axis direction (X-axis direction). That is, the second separation distance 61 may be in a range of 20 mm to 150 mm.

Referring to FIGS. 1 to 12, a depth 62 of the second inducing groove 6 and a depth 52 of the first inducing groove 5 may be implemented to be the same. That is, the second inducing groove 6 and the first inducing groove 5 may be formed to have the same depth. Accordingly, the metal foil core 1 according to the present disclosure may induce the sag, the deformation, and the like, which substantially coincide with each other, to occur on both sides of the winding member 2.

The second inducing groove 6 may be formed to have a depth corresponding to the depth ratio in a range of 0.1 to 0.5. The depth ratio of the second inducing groove 6 may be calculated using Equation 3. In this case, in Equation 3, PD denotes a thickness 42 of the second protrusion member 4, and GD denotes the depth 62 of the second inducing groove 6. The depth ratio of the second inducing groove 6 according to Equation 3 may correspond to a ratio of the depth 62 of the second inducing groove 6 to the thickness 42 of the second protrusion member 4. The depth ratio of the second inducing groove 6 and the depth ratio of the first inducing groove 5 may be implemented to be the same. Meanwhile, in the position ratio of the second inducing groove 6, the length 41 of the second protrusion member 4 may be calculated using Equation 2. The length 41 of the second protrusion member 4 and the length 31 of the first protrusion member 3 may be implemented to be the same.

Meanwhile, in Equation 3, the thickness 42 of the second protrusion member 4 may be calculated using Equation 4. In this case, in Equation 4, OD denotes an outer diameter 421 of the second protrusion member 4, and ID denotes an inner diameter 422 of the second protrusion member 4. The thickness 42 of the second protrusion member 4 and the thickness 32 of the first protrusion member 3 may be implemented to be the same.

Referring to FIGS. 1 to 12, a width 63 of the second inducing groove 6 may be smaller than the depth 62 thereof. In this case, the width 63 of the second inducing groove 6 is smaller than the depth 62 of the second inducing groove 6. The width 63 of the second inducing groove 6 is based on the first axis direction (X-axis direction).

The depth 62 of the second inducing groove 6 may be two times the width 63 of the second inducing groove 6. In this case, a ratio (hereinafter, referred to as a "second width ratio") of the width to the processing depth of the second inducing groove 6 may be 0.5. The second width ratio may be calculated by dividing the width 63 of the second inducing groove 6 by the depth 62 of the second inducing groove 6. Meanwhile, the second width ratio may mean how wide the width 63 is formed as compared to the depth 62 of the second inducing groove 6. As the second inducing groove 6 is formed to have the second width ratio of 0.5, in the metal foil core 1 according to the present disclosure, the defect rate for the metal foil 100 wound around the winding member 2 can be reduced without the self-damage or deformation.

The width 63 of the second inducing groove 6 and the width 53 of the first inducing groove 5 may be implemented to be the same. That is, the second inducing groove 6 and the first inducing groove 5 may be formed to have the same width. Thus, the metal foil core 1 according to the present disclosure may induce the sag, the deformation, and the like, which substantially coincide with each other, to occur on both sides of the winding member 2. The second inducing groove 6 and the first inducing groove 5 may be formed to have the same depth as well as the same width.

The second inducing groove 6 may be implemented in the same manner as the first inducing groove 5 according to the embodiments. In this case, the second inducing groove 6 may be formed to have a triangular cross section as illustrated in FIG. 5, to have a trapezoidal cross section as illustrated in FIG. 6, to have a cross section in which a trapezoidal shape and a quadrangular shape are combined as illustrated in FIG. 7, and to have a cross section in which a trapezoidal shape having a concave outer surface and a quadrangular shape are combined as illustrated in FIG. 8, based on the cross-sectional direction.

Figure 13:
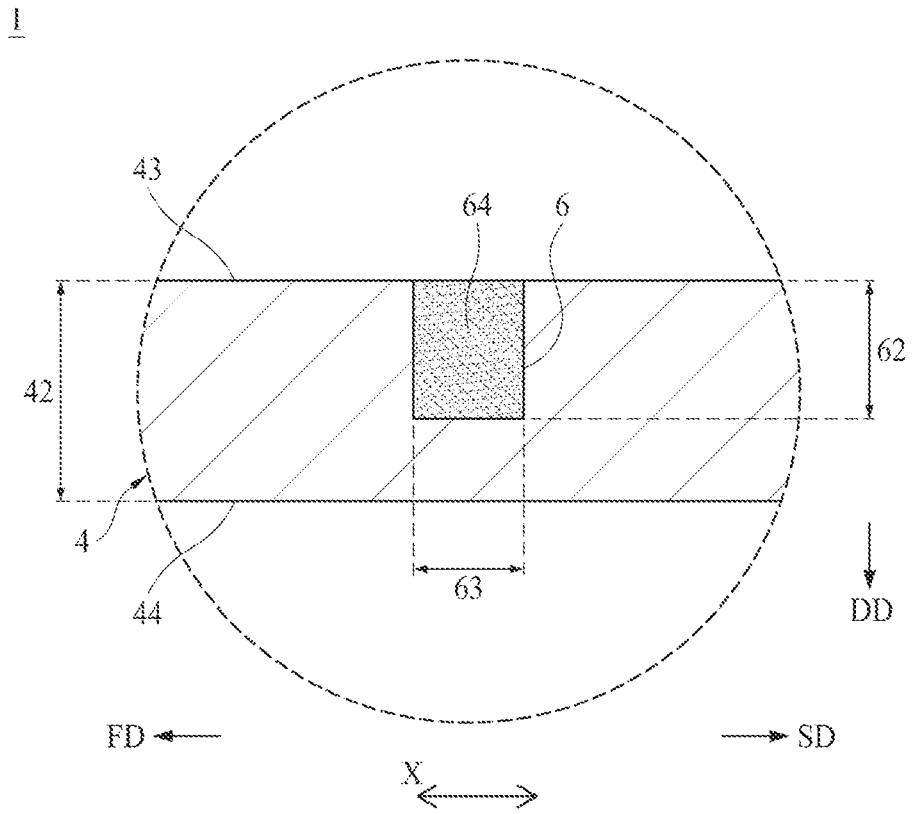
FIGS. 13 and 14 are schematic enlarged side cross-sectional views illustrating embodiments of a second inducing groove of the metal foil core in part B of FIG. 2 according to the present disclosure.

Referring to 13, s second buffer member 64 may be inserted into the second inducing groove 6. The second buffer member 64 may be made of an elastically deformable material. For example, the second buffer member 64 may be formed of rubber, urethane, or the like. The second buffer member 64 may buffer or absorb the sag, the deformation, and the like generated at portions of the second protrusion member 4 in which the second inducing groove 6 is formed, and thus can reduce the degree to which an impact due to the corresponding sag, the corresponding deformation, and the like is transmitted to the metal foil 100. The second buffer member 64 may be formed to have the same shape as the second inducing groove 6. FIG. 13 illustrates the second inducing groove 6 and the second buffer member 64 that are formed to have a rectangular cross section based on the cross-sectional direction, but the present disclosure is not limited thereto, and the second inducing groove 6 and the second buffer member 64 may be formed to have a triangular cross section as illustrated in FIG. 5, to have a trapezoidal cross section as illustrated in FIG. 6, to have a cross section in which a trapezoidal shape and a quadrangular shape are combined as illustrated in FIG. 7, and to have a cross section in which a trapezoidal shape having a concave outer surface and a quadrangular shape are combined as illustrated in FIG. 8, based on the cross-sectional direction. When the second inducing groove 6 and the second buffer member 64 are formed to have a cross section in which a trapezoidal shape and a quadrangular shape are combined as illustrated in FIG. 7, and to have a cross section in which a trapezoidal shape having a concave outer surface and a quadrangular shape are combined as illustrated in FIG. 8, the second inducing groove 6 may include a second corner groove (not illustrated). Since the second corner groove may be implemented to be substantially identical to the first corner groove 54, a detailed description thereof will be omitted.

Figure 12:
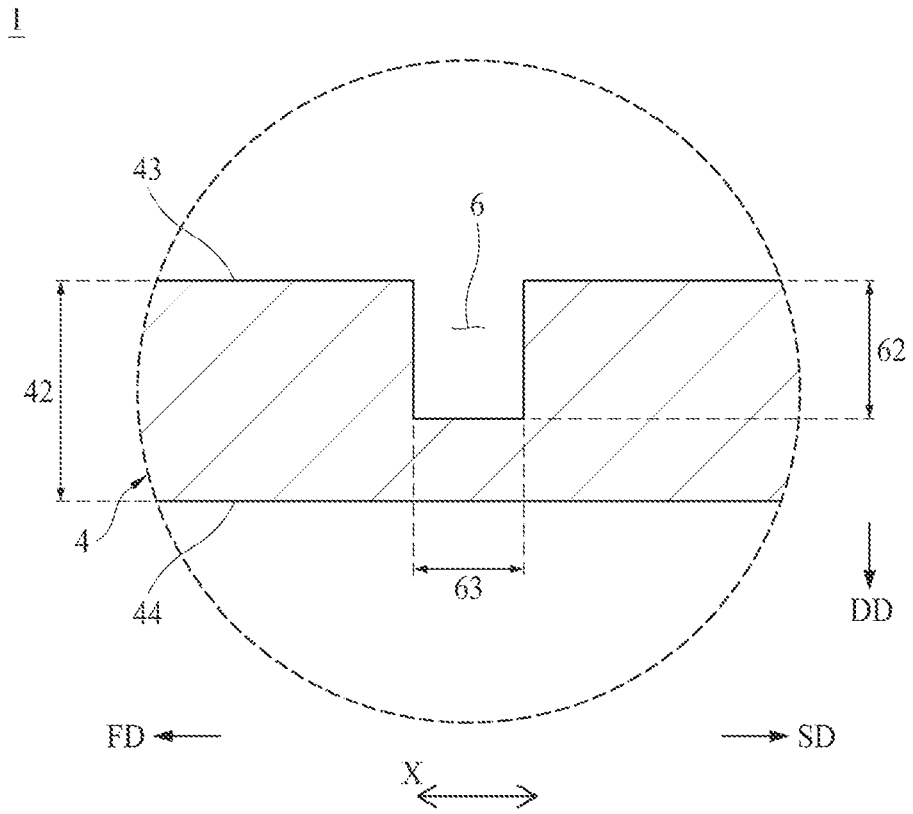
FIG. 12 is a schematic enlarged side cross-sectional view illustrating part B of FIG. 2.

As illustrated in FIGS. 12 and 13, the second inducing groove 6 may be formed in an outer surface 43 of the second protrusion member 4. The outer surface 43 of the second protrusion member 4 is a reference surface for the outer diameter 421 (see FIG. 2) of the second protrusion member 4. In this case, the second inducing groove 6 may be formed as a groove extending from the outer surface 43 of the second protrusion member 4 toward an inner surface 44 of the second protrusion member 4 in the depth direction (DD arrow direction). The inner surface 44 of the second protrusion member 4 is a reference surface for the inner diameter 422 (see FIG. 2) of the second protrusion member 4.

Figure 14:
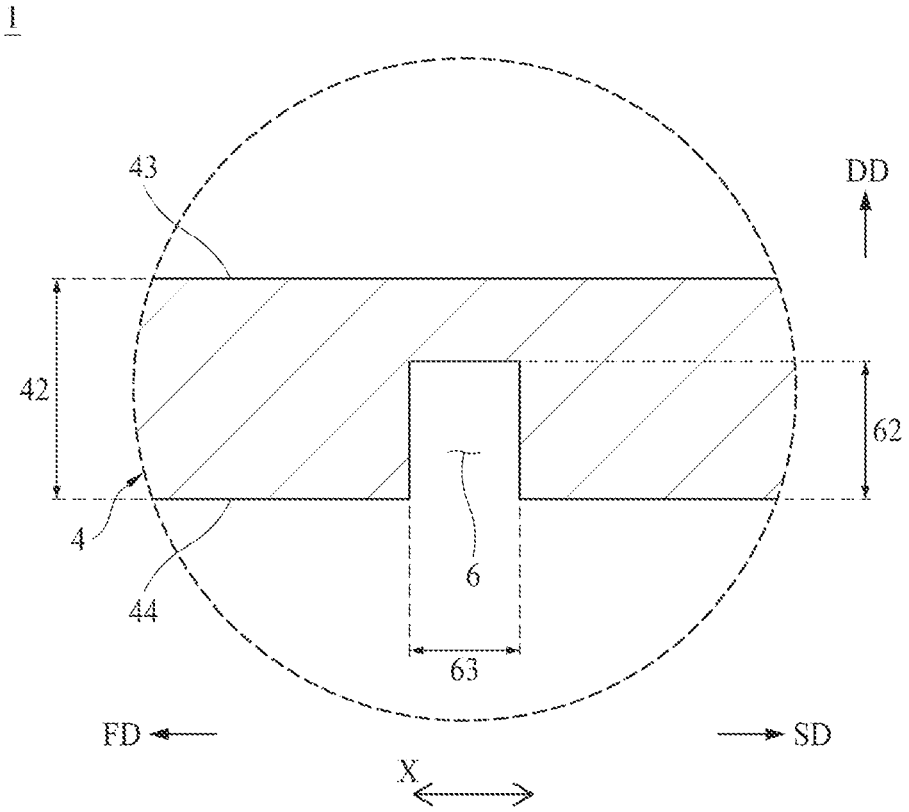

Referring to FIG. 14, the second inducing groove 6 may be formed in the inner surface 44 of the second protrusion member 4. In this case, the second inducing groove 6 may be formed as a groove extending from the inner surface 44 of the second protrusion member 4 toward the outer surface 43 of the second protrusion member 4 in the depth direction (DD arrow direction). As compared to a case in which the second inducing groove 6 is formed in the outer surface 43 of the second protrusion member 4, when the second inducing groove 6 is formed in the inner surface 44 of the second protrusion member 4, a larger moment of inertia may be obtained, and thus the metal foil core 1 according to the present disclosure may have higher rigidity. Meanwhile, the second inducing groove 6 formed in the inner surface 44 of the second protrusion member 4 may be formed to have a rectangular cross section as illustrated in FIG. 14, to have a triangular cross section as illustrated in FIG. 5, to have a trapezoidal cross section as illustrated in FIG. 6, to have a cross section in which a trapezoidal shape and a quadrangular shape are combined as illustrated in FIG. 7, and to have a cross section in which a trapezoidal shape having a concave outer surface and a quadrangular shape are combined as illustrated in FIG. 8, based on the cross-sectional direction. The second buffer member 64 may be inserted into the second inducing groove 6 formed in the inner surface 44 of the second protrusion member 4.

Although not illustrated, the metal foil core 1 according to the present disclosure may include a plurality of second inducing grooves 6. The second inducing grooves 6 may be spaced apart from each other in the first axis direction (X-axis direction). Accordingly, in the metal foil core 1 according to the present disclosure, the sag, the deformation, and the like may be distributed to the portions of the second protrusion member 4 in which the second inducing grooves 6 are formed. Thus, in the metal foil core 1 according to the present disclosure, a risk of damage and break to the second protrusion member 4 can be further reduced even while the defect rate for the metal foil 100 can be reduced. The metal foil core 1 according to the present disclosure may be implemented such that the number of second inducing grooves 6 is the same as the number of first inducing grooves 5. The second inducing grooves 6 may be formed in the outer surface 43 of the second protrusion member 4 or the inner surface 44 of the second protrusion member 4. The second inducing grooves 6 may be formed in both the outer surface 43 of the second protrusion member 4 and the inner surface 44 of the second protrusion member 4.

According to the present disclosure, the following effects can be achieved.

According to the present disclosure, sag, deformation, and the like caused a load of a metal foil and vibrations, shaking, impact, and the like generated during transportation can be induced to be intensively generated at a portion of a first protrusion member in which a first inducing groove is formed. Therefore, according to the present disclosure, the sag, the deformation, and the like generated in a winding member can be reduced, and thus defects such as machine direction (MD) buckle and fusilli occurring in the metal foil wound around the winding member can be reduced. Thus, the present disclosure can contribute to improving the quality of the metal foil that has been completely handled and transported, and to improving the stability and ease of a handing process and a transporting process for the metal foil.

The present disclosure described above is not limited to the above-described embodiments and the accompanying drawings, and it is apparent to those skilled in the art to which the present disclosure belongs that various substitutes, modifications, and changes can be made without departing from the technical spirit of the present disclosure.

What is claimed is:

1. A metal foil core comprising:

a winding member around which a metal foil is wound;

a first protrusion member protruding from the winding member in a first direction (direction of arrow FD) of a first axis direction (X-axis direction);

a second protrusion member protruding from the winding member in a second direction (direction of arrow SD) opposite to the first direction (direction of arrow FD) of the first axis direction (X-axis direction); and a first inducing groove defined on the first protrusion member that is disposed between a first end and a second end of the first protrusion member in the first axis direction (X-axis direction), wherein the first protrusion member is supported by a support part of an accommodation device, the first inducing groove induces a sag and a deformation to be intensively generated at a portion of the first protrusion member in which the first inducing groove is formed.

2. The metal foil core of claim 1, wherein the first inducing groove is disposed at a position corresponding to a position ratio in a range of 0.1 to 0.3, wherein the position ratio is calculated using Equation $$PLLR = \frac{AD}{PL},$$

wherein PLLR denotes the position ratio, AD denotes a first separation distance by which the first inducing groove and one end of the first protrusion member, facing the first direction (direction of arrow FD), are spaced apart from each other in the first axis direction (X-axis direction), and PL denotes a length of the first protrusion member in the first axis direction (X-axis direction).

3. The metal foil core of claim 2, wherein PL is calculated using Equation $$PL=(TL-WI)=2$$

wherein TL denotes a total length of the metal foil core in the first axis direction (X-axis direction), and WL denotes a length of the winding member in the first axis direction (X-axis direction).

4. The metal foil core of claim 1, wherein the first inducing groove is disposed at a position spaced a distance in a range of 20 mm to 150 mm from one end of the first protrusion member, facing the first direction (direction of arrow FD), in the first axis direction (X-axis direction).

5. The metal foil core of claim 1, wherein the first inducing groove is formed to have a depth corresponding to a depth ratio in a range of 0.1 to 0.5, wherein the depth ratio is calculated using Equation $$PDTR = \frac{GD}{PD},$$

wherein PDTR denotes the depth ratio, PD denotes a thickness of the first protrusion member, and GD denotes the depth of the first inducing groove.

6. The metal foil core of claim 5, wherein PD is calculated using Equation $$PD=(OD-ID)+2,$$

wherein OD denotes an external diameter of the first protrusion member, and ID denotes an inner diameter of the first protrusion member.

7. The metal foil core of claim 1, wherein a width of the first inducing groove in the first axis direction (X-axis direction) is smaller than a depth of the first inducing groove.

8. The metal foil core of claim 1, wherein a depth of the first inducing groove is two times a width of the first inducing groove in the first axis direction (X-axis direction).

9. The metal foil core of claim 1, wherein a depth of the first inducing groove is greater than a thickness of the metal foil wound around the winding member.

10. The metal foil core of claim 1, wherein the first inducing groove is formed in a circumferential surface of the first protrusion member.

11. The metal foil core of claim 1, wherein a plurality of first inducing grooves are formed in the first protrusion member, and the first inducing grooves are spaced apart from each other in the first axis direction (X-axis direction).

12. The metal foil core of claim 1, wherein a size of the first inducing groove decrease as the first inducing groove extends in a depth direction (direction of arrow DD).

13. The metal foil core of claim 1, wherein the first inducing groove includes a first corner groove formed in a corner connected to an outer surface of the first protrusion member or an inner surface of the first protrusion member, and a size of the first corner groove decreases as the first corner groove extends in a depth direction (direction of arrow DD).

14. The metal foil core of claim 13, wherein a portion of the first protrusion member in which the first corner groove is formed is formed to have an inclined surface or a curved surface.

15. The metal foil core of claim 1, wherein a first buffer member that is elastically deformable is inserted into the first inducing groove.

16. The metal foil core of claim 1, wherein the first inducing groove is defined on an outer surface of the first protrusion member defined between the first end and the second end of the first protrusion member.

17. The metal foil core of claim 1, wherein the first inducing groove is defined on an inner surface of the first protrusion member defined between the first end and the second end of the first protrusion member.

18. The metal foil core of claim 1, further comprising:

a second inducing groove in defined on the second protrusion member that is disposed between a first end and a second end of the second protrusion member in the first axis direction (X-axis direction).

19. The metal foil core of claim 18, wherein a first separation distance by which the first inducing groove is spaced apart from one end of the first protrusion member facing the first direction (direction of arrow FD) and a second separation distance by which the second inducing groove is spaced apart from one end of the second protrusion member facing the second direction (direction of arrow SD) are the same.

20. The metal foil core of claim 18, wherein the second inducing groove and the first inducing groove are formed to have the same depth and are formed to have the same width in the first axis direction (X-axis direction).

* * * * *